US005160282A

United States Patent [19]

Swaffield et al.

[11] Patent Number: 5,160,282

[45] Date of Patent: Nov. 3, 1992

[54] HIGH DENSITY CONNECTOR MODULE

[75] Inventors: John D. Swaffield, Woburn; John T. Doyle, Danvers, both of Mass.

[73] Assignee: Precission Connector Devices, Inc., Peabody, Mass.

[21] Appl. No.: 863,368

[22] Filed: Apr. 1, 1992

Related U.S. Application Data

[63] Continuation of Ser. No. 794,798, Nov. 19, 1991, abandoned, which is a continuation of Ser. No. 672,776, Mar. 20, 1991, abandoned, which is a continuation of Ser. No. 429,194, Oct. 27, 1989, abandoned.

[51] Int. Cl.[5] ..... H01R 9/22

[52] U.S. Cl. ..... 439/721; 439/724

[58] Field of Search ..... 439/709, 721, 722, 723, 439/724, 725, 712, 715, 716, 843, 847, 856

[56] References Cited

U.S. PATENT DOCUMENTS

| | | | |
|---|---|---|---|
| 3,383,643 | 5/1968 | Nava et al. | 439/724 |
| 3,508,189 | 4/1970 | Culver | 439/724 |
| 3,594,714 | 7/1971 | Paullus et al. | 439/723 X |
| 3,597,726 | 8/1971 | Appleton et al. | 439/724 |
| 3,732,522 | 5/1973 | Hartwell et al. | 439/847 X |
| 4,784,619 | 11/1988 | Blanchet | 439/724 |

*Primary Examiner*—Larry I. Schwartz
*Assistant Examiner*—Khiem Nguyen
*Attorney, Agent, or Firm*—Jerry Cohen; Edwin H. Paul; Harvey Kaye

[57] ABSTRACT

A contact element of unitary construction, the contact element including a plurality of contact element mating portions which are connected via serpentine portions. The contact element being used in connector modules and providing both electrical connection and mechanical retention.

11 Claims, 3 Drawing Sheets

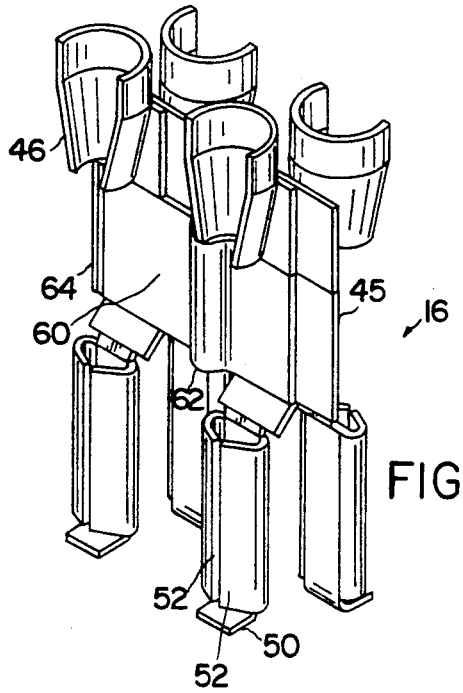
FIG.5
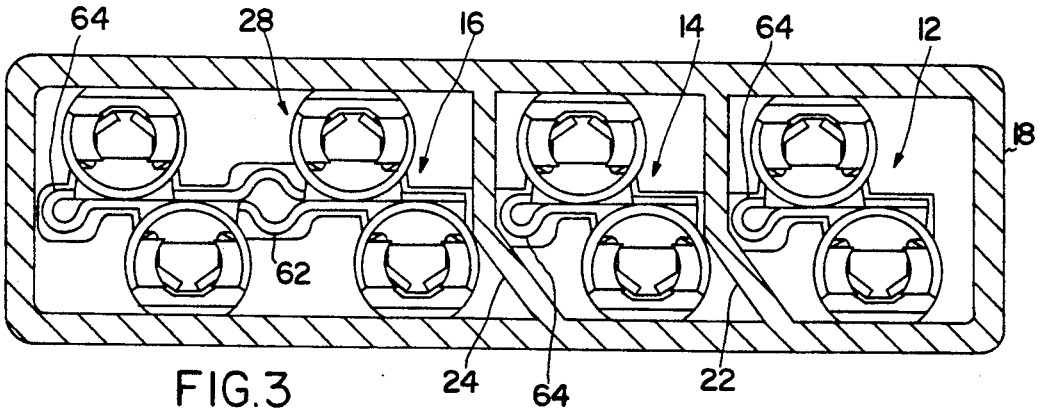
FIG.3
FIG.4
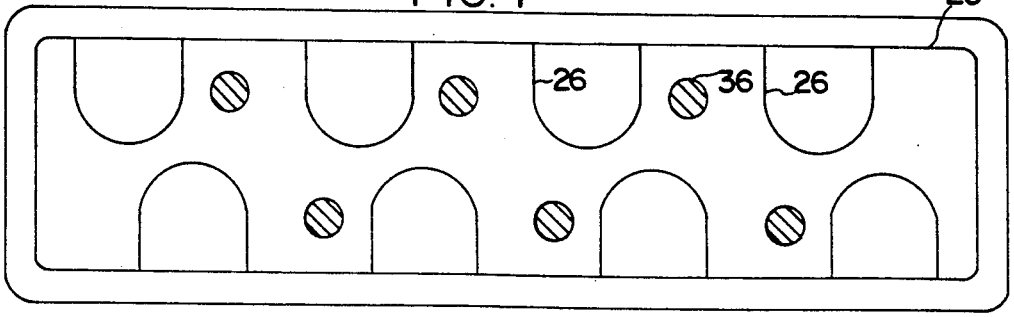

HIGH DENSITY CONNECTOR MODULE

This is a continuation of application Ser. No. 07/794,798, filed Nov. 19, 1991, now abandoned, which was a continuation of application Ser. No. 07/672,776, filed Mar. 20, 1991, now abandoned, which was a continuation of application Ser. No. 07/429,194, filed Oct. 27, 1989, now abandoned.

FIELD OF THE INVENTION

The invention relates to high density connector modules.

BACKGROUND OF THE INVENTION

It is known to use high density connector modules in applications which require many wires to be connected in a small space, e.g. to connect wires in aircraft.

It is also known to provide such high density connector modules with connector contacts which are constructed of a plurality of pieces joined, e.g., by soldering. Such contacts may have different pieces for electrical connection and mechanical retention.

It is also known to provide a connector module which includes a housing defining a recess and a contact element having a plurality of integral contact element mating portions. Each contact element mating portion includes one side which functions as a retainer portion and another side which includes a portion which partially surrounds a pin to electrically engage the pin. The contact element mating portions are connected with flat bus portions.

SUMMARY OF THE INVENTION

It has been discovered that by providing a contact element having a plurality of integral contact element mating portions connected via serpentine portions provides a high density connector module which is easy to manufacture.

In preferred embodiments, the serpentine portions include at least one pinched portion, the serpentine portions include at least one reverse direction portion, which forms a rounded loop, and the contact element mating portions each include a bus portion which physically contacts and electrically engages a support wall of another contact element mating portion. The result is the contact element is bent at the serpentine portions, with the serpentine portions forming a rounded loop, over a 360 degree arc such that the sections of the electrically conductive metal strip means on either side of the bent serpentine portion are contacting back to back with a loop transition as opposed to a flat bend transition. ,

PREFERRED EMBODIMENT

The attached drawings illustrate the preferred embodiment, the structure and operation of which is then described.

DRAWINGS

FIG. 3 shows a cross-sectional view along lines 3—3 of the FIG. 1 connector module.

FIG. 4 shows a cross-sectional view along lines 4—4 of the FIG. 1 connector module.

FIG. 5 shows a perspective view of a four-mating portion connector element of the FIG. 1 connector module.

STRUCTURE

Figure 1:
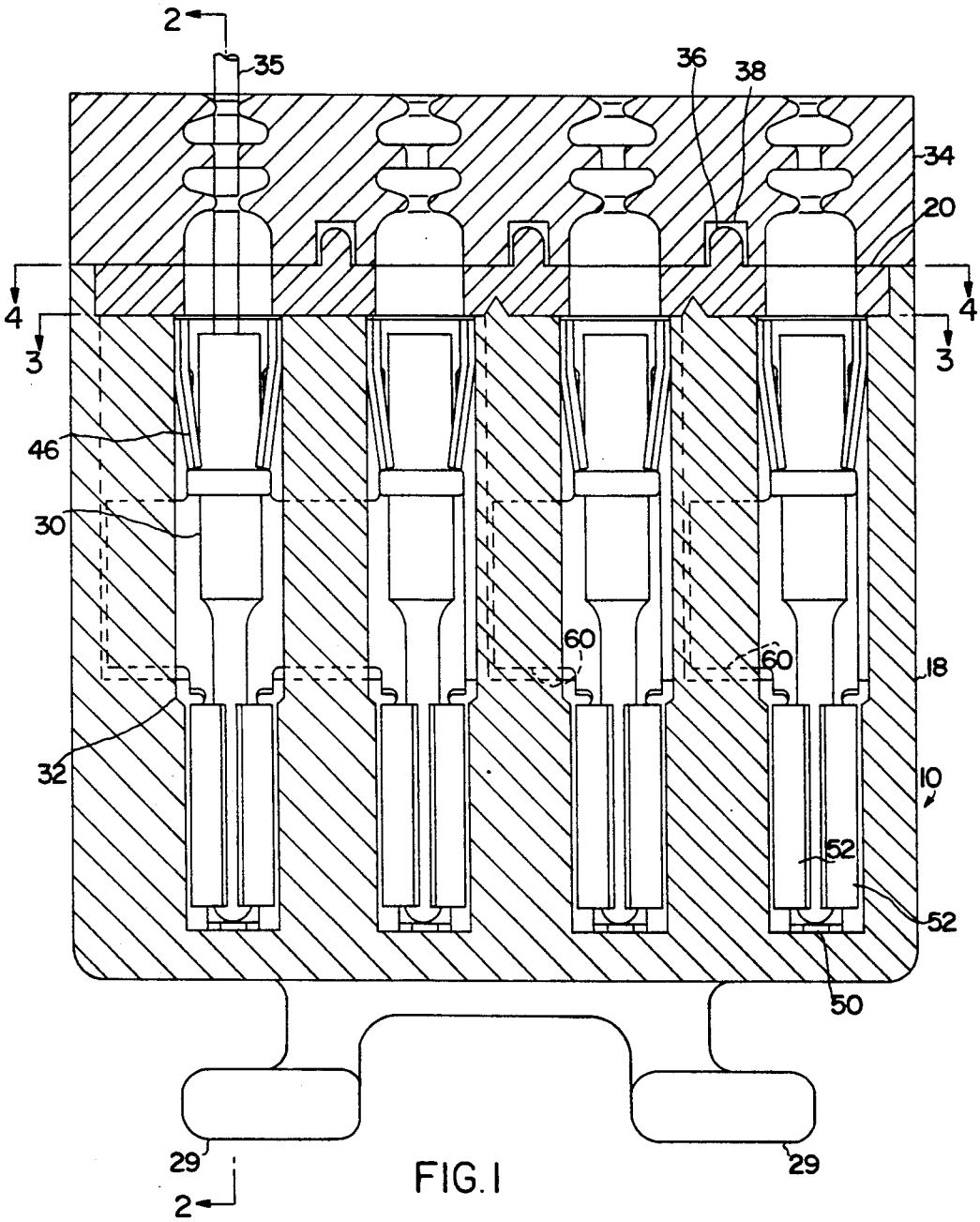
FIG. 1 shows a side, partially sectioned, view of a high density connector module according to the present invention.
Figure 2:
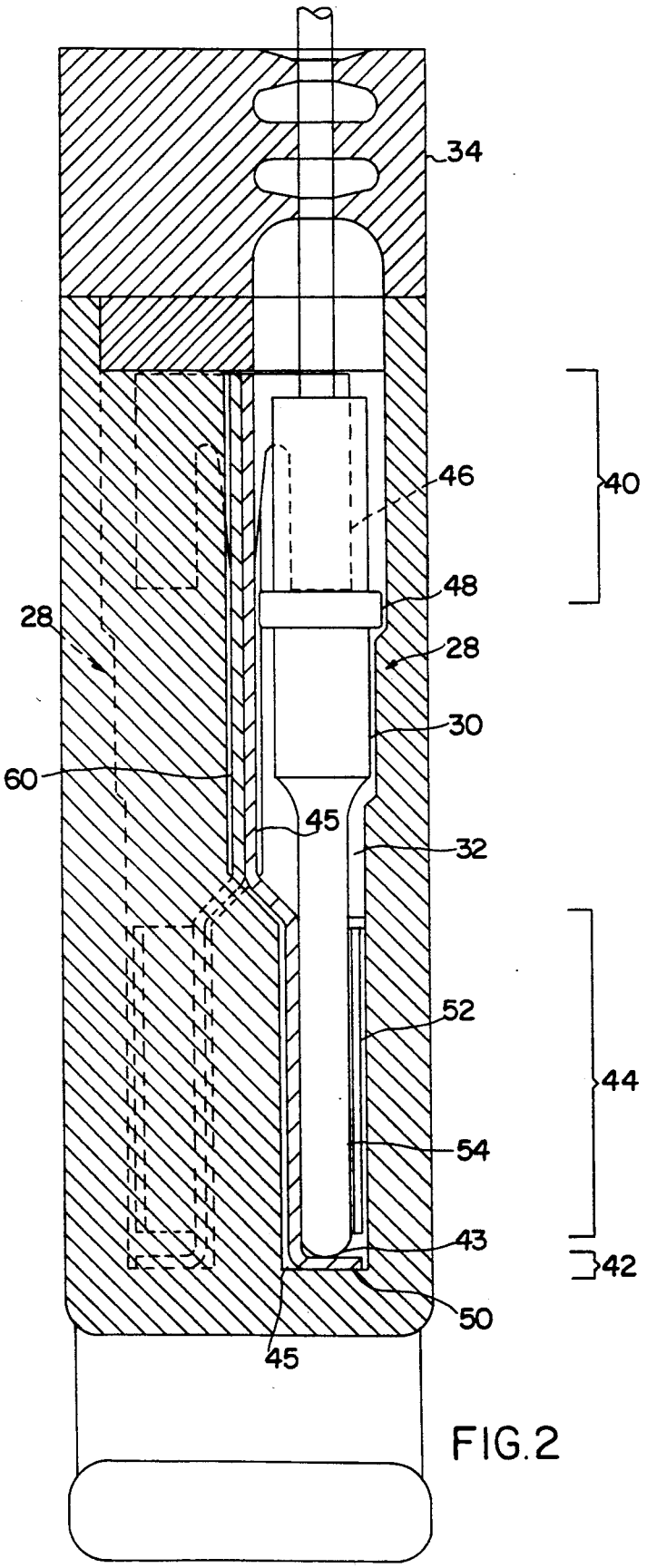
FIG. 2 shows a cross-sectional view along lines 2—2 of the FIG. 1 connector module.

Referring to FIGS. 1-5, high density connector module 10 includes two two-mating portion contact elements or buses 12, 14 and one four-mating portion contact element 16 (each contact element being constructed from a single sheet of beryllium copper) contained within polyethermide housing 18. Housing cap 20 holds contact elements 12, 14, 16 securely within respective recesses of housing 18. Contact elements 12, 14, 16 are electrically separated by continuous walls 22, 24 of housing 18.

Housing cap 20, which is constructed of a thermoplastic, is ultrasonically welded to housing 18 after contact elements 12, 14, 16 are inserted. Housing cap 20 includes U-shaped recesses 26, which each have a smaller inner diameter than the outer diameter of respective contact element mating portions 28. Housing 18 includes mounting legs 29 which allow connector module 10 to be mounted to a securing structure (not shown).

FIG. 1 shows mating pin contacts 30 inserted into respective contact element mating portions 28. Contact element mating portions 28 correspond to mating recesses 32 of housing 18. After pin contacts 30 are inserted into mating portions 28, silicon elastomer wire sealing grommet 34 is secured to housing cap 20 by an adhesive bond. Housing cap 20 includes projections 36 which correspond to recesses 38 in grommet 34. Grommet 34 surrounds wires 35, which are connected to pin contact 30.

Each contact element mating portion 28 includes retainer portion 40, stop portion 42 and electrical contact portion 44, which is gold plated at the points of contact between portion 44 and pin contact 30. Portions 40, 42 and 44 are integrally connected via a mating pin contact support wall 45. Retainer portion 40 includes two resilient, inwardly oriented retainer tines 46, which movably extend within the outer circumference of mating portion 48 of pin contact 30. Stop portion 42 includes inwardly directed stop 50, which fixedly extends across the bottom of mating recess 32. Contact portion 44 includes two resilient contact walls 52, 52 which partially surround and contact mating portion 54 of pin contact 30. Contact walls 52 are contiguous with a portion of mating pin contact support wall 45.

Pin contact support wall 45 includes a bus portion 60 which is contiguous with and electrically connected to the center portion of support wall 45. Bus portion 60 is connected to another contact element mating portion 28 via a serpentine portion. The serpentine portion may be pinched portion 62 or reverse direction portion 64. Bus portion 60 is oriented to physically and electrically contact a portion of a pin contact support wall 45 of another contact element mating portion 28.

OPERATION

Referring to FIGS. 1-5, high density connector module 10 is used to connect a plurality of wires in a relatively small amount of space. Contact elements 12, 14 provide electrical connection between two contact pins 30 as well as mechanical retention for each respective contact pin 30. Contact element 16 provides electrical connection between four contact pins 30.

More specifically, contact pins 30 are inserted into connector module 10 by using an insertion tool (not shown) to spread retainer tines 46 so that mating portion 48 may be inserted past tines 46. Because there are two opposing tines, contact pin 30 is symmetrically and securely retained. Stop portion 42 prevents the tip of pin contact 43 from touching the bottom of housing mating recess 45 into which pin contact 30 extends. As pin contact 30 is inserted into mating recess 32, contact walls 52 are spread apart, partially surrounding contact portion 54 and providing electrical connection between contact element 12 and pin contact 30. Accordingly, contact element 12 both mechanically retains and electrically connects pin contact 30.

With contact elements 12, 14, two pin contacts 30 are electrically connected via bus portion 60 both because two mating portions 28 are physically connected via reverse direction portion 64 and because contact elements 12, 14 are configured so that bus portions 60 of one mating pin contact abut with and electrically engage a portion of mating pin contact support wall 45 of the other mating pin contact. With contact element 16, four pin contacts 30 are electrically connected.

Additionally, because the connection between mating pin contacts 28 include a serpentine portion (i.e., either pinched portion 62 or reverse direction portion 64,), mating pin contacts 28 may be fabricated as a continuous strip. Connector elements having the desired number of contact element mating portions are then detached from the strip. Pinched portions 62 are then provided to space the contact element mating portions more closely together. Reverse direction portions 64 are then provided to increase the number of pin contacts which can be connected by a single contact element.

OTHER EMBODIMENTS

Other embodiments are within the following claims.

A contact element may connect any number of contact pins together and any combination of contact elements may be provided within the same connector module. Or a contact element may be used to electrically connect a contact pin to any other type of signal carrying member, such as a bus bar.

What is claimed is:

1. A connector module for electrically connecting and mechanically retaining a plurality of contact pins comprising, in combination:

(a) housing means, made of electrically insulating material, defining at least one recess;

(b) metal strip means defining a series of electrically conductive contacts, each metal strip means being positioned within each housing means recess, said metal strip means being constructed of one piece and including:

(i) means defining a plurality of integral contact mating elements, each constructed and arranged to receive one contact pin, including means defining a mating element retainer portion configured to mechanically retain the contact pin, and means defining a mating element electrical connection portion configured to engage the contact pin to provide an electrical connection between the pin and the mating element, (ii) electrically conductive joining portions between adjacent integral contact mating element means with at least one such joining portion including a serpentine portion, wherein said serpentine portion and said mating elements extend outward in one direction from the joining portion, and wherein the opposite side of the outwardly extending mating elements defines a back surface of said metal strip means, and wherein said metal strip means is bent substantially over a 360 degree arc at said serpentine portion such that said metal strip means, on either side of said bent serpentine portion, is configured contacting back to back, and wherein said bent serpentine portion is constructed and arranged as a rounded loop.

2. A connector module as defined in claim 1, wherein each mating element electrical connection portion further comprises a stop portion, each stop portion constructed and arranged to prevent the contact pin from extending axially beyond a predetermined point.

3. A connector module as defined in claim 1, wherein said mating element retainer portion comprises at least one retainer tine constructed and arranged to mate with and retain said contact pin.

4. A connector module as defined in claim 3 wherein said mating element retainer portion includes opposing tines.

5. A connector module as defined in claim 1 wherein said insulating material is thermoplastic.

6. A connector module as defined in claim 1 wherein said electrically conducting material is beryllium copper alloy with gold plating at said electrical connection portion.

7. A connector module as defined in claim 1, wherein each joining portion includes a serpentine portion.

8. A connector module as defined in claim 1 wherein said electrical conducting mating means includes a recess, substantially enclosed by a wall of said electrically conductive material, coaxial with said pin, wherein said wall forms a spring wherein a pin extending longitudinally into said enclosed recess flexes said spring wall and contacts said wall in at least three distinct and separate points, providing spring loaded redundant electrical connections.

9. A connector module as defined in claim 1, wherein said housing defines a plurality of recesses, each electrically isolated from each other, and a plurality of said electrically metal strip means, each positioned within a respective recess.

10. A connector module as defined in claim 1, wherein said bent serpentine portion rounded loop is substantially circular or elliptical.

11. A connector module for electrically connecting and mechanically retaining a plurality of contact pins, comprising, in combination:

(a) housing means, fabricated from thermoplastic, defining electrically isolated recesses;

(b) a plurality of metal strip means each made of electrically conducting material defining a series of electrically conductive contacts, each metal strip means positioned within a corresponding respective recess, and each metal strip means constructed of a single piece and including:

(i) means defining a plurality of integral contact mating elements, said mating elements, constructed and arranged to receive said contact pins each contact mating element including means defining a mating element retainer portion configured to mechanically retain the contact pin, and means defining a mating element electrical connection portion configured to engage the contact pin to provide an electrical connection between said pin and said mating element, (ii) electrical conductive joining portions between adjacent mating integral contact mating elements with at least one said joining portions including a serpentine portion, wherein said serpentine portion and said mating elements extend outwardly in one direction from said joining portion and wherein the opposite side of the outwardly extending mating elements defines a back surface of said metal strip means, and wherein said metal strip means is bent at the serpentine portion such that said metal strip means, on either side of said bent serpentine portion, is configured contacting back to back, and wherein said bent serpentine portion is constructed and arranged in a rounded loop, over a 360 degree arc, and each mating element electrical connection portion further including a stop portion constructed and arranged to prevent the contact pin from extending axially beyond a predetermined point, and wherein said mating element retainer portion includes at least one retainer tine constructed and arranged to mate with and retain said contact pin, wherein said electrically conducting material is beryllium copper with gold plating at said electrical connection portion, and wherein said electrical connection portion includes a recess, substantially enclosed by a wall of said electrically conductive material, coaxial with said pin, wherein said wall forms a spring wherein a pin extending longitudinally into said enclosed recess flexes said spring wall and makes electrical contact in at least three distinct and separate points, providing spring loaded redundant electrical connections.

* * * * *